United States Patent [19]

Nothmann

[11] Patent Number: 4,762,065

[45] Date of Patent: Aug. 9, 1988

[54] SHEET INFEED MECHANISM FOR A PRINTING MACHINE

[75] Inventor: Gerhard W. Nothmann, Pasadena, Calif.

[73] Assignee: Xerox Corporation, Stamford, Conn.

[21] Appl. No.: 93,831

[22] Filed: Sep. 8, 1987

[51] Int. Cl.[4] ..... B41F 21/04

[52] U.S. Cl. ..... 101/409; 101/246

[58] Field of Search ..... 101/246, 408, 409, 410, 101/411, 412; 400/642, 645.5; 271/82, 85, 204, 206, 268, 277; 226/198

[56] References Cited

U.S. PATENT DOCUMENTS

| | | | |
|---|---|---|---|
| 1,026,606 | 5/1912 | Robb | 271/277 |
| 1,095,125 | 4/1914 | Rogers et al. | 271/82 X |
| 1,895,124 | 11/1933 | Crafts et al. | 101/409 |
| 2,095,498 | 10/1937 | Hanouer | 101/409 |
| 2,378,478 | 6/1945 | Harless | 101/409 |
| 2,378,523 | 6/1945 | Worthington | 101/409 |
| 2,406,205 | 8/1946 | Davidson et al. | 101/409 X |
| 3,196,767 | 7/1965 | Eichorn | 271/277 X |

*Primary Examiner*—Charles Pearson

*Attorney, Agent, or Firm*—Robert E. Cunha

[57] ABSTRACT

This invention is an infeed mechanism for a sheet fed printing machine comprising a chute for guiding a sheet from a staging position into an array of moving grippers. To improve the reliability and accuracy of placement of the sheet leading edge into the gripper throat, a plurality of flexible strips, each longer than the one above, is attached to the chute bottom edge facing the grippers, the strips coming into sequential resilient contact with the open gripper fingers. The strips therefore become a flexible extension of the lower edge of the chute and serve to constrain the sheet lead edge movement into the moving gripper fingers regardless of instantaneous mechanical misalignments and sheet imperfections.

8 Claims, 4 Drawing Sheets

SHEET INFEED MECHANISM FOR A PRINTING MACHINE

BACKGROUND OF THE INVENTION

Printing machines produce images on sheets or webs of paper and similar materials. When in sheet form, such materials are normally piled in the feeder of the machine in preparation for printing. Mechanism is then required for separating one sheet at a time from this pile, normally from the top, and for moving this sheet through the machine for application of the image, and possibly for other processing, after which the sheet is normally deposited on a second pile in the delivery of the machine. This process usually takes place continuously, with a subsequent sheet being separated from the feeder pile for printing while the previous sheet may still be in the final stages of the process of being printed and delivered.

In machines for printing high quality multicolor images, the sheet must be moved with high precision and repeatability of position and the means for holding the sheet in this movement must be adapted to the printing process. This is commonly accomplished by sets of grippers, holding the leading edge of the sheet, which are mounted either near the surface of a rotating transfer drum cylinder or are part of a moving gripper bar. To be adapted to the printing process, the grippers must be formed to occupy a relatively small space but nevertheless capable of exerting high forces on the leading edge of the sheet so as to avoid slippage during the process. As a result, the opening of these grippers, commonly referred to as a gripper throat, into which the leading edge of the sheet must be introduced after separation from the feeder pile, is commonly quite narrow. The mechanism for feeding the sheet into this gripper throat, commonly referred to as infeed mechanism, must therefore control the sheet in a precise manner so as to avoid misfeeding of the leading edge above or below this throat. This control is particularly important when there are wrinkles or curly portions in the leading edge of the sheet as commonly occurs in such applications.

Previous infeed mechanisms have been complex and mechanically unstable. In one of these mechanisms, the sheet is guided through a chute whose motion is governed by a four bar linkage mechanism. The accurate control of this linkage mechanism is difficult and an occasional paper misfeed occurs when the operation of the machine is extended to sheet stocks of diverse thickness, stiffness, surface texture, and curl, such as is required in many applications. One of the causes of malfunction is the variable surface friction of various sheet stocks which results in slight variations in the speed with which sheets are forwarded to the position where the leading edge is introduced into the gripper throat. Because of the resulting delays in sheet arrival the leading edge occasionally does not reach the gripper throat or, alternately the leading edge is gripped only partly during closure of the gripper fingers. The alignment of the chute in relation to the moving array of grippers, during the movement of the leading edge of the sheet into the gripper throat, has likewise proven to be unreliable and misfeeds have been experienced in this area. An improvement of this mechanism in which the same type of chute is controlled by a ball screw mechanism has not offered significant advantages, especially at the high process speeds which are commonly required in such machines.

SUMMARY OF THE INVENTION

The proposed invention provides a chute mechanism for feeding sheets of material to be printed into an array of grippers or a gripper bar. The advantages of the invention reside in the greater variety of sheet materials which can be moved reliably in this mechanism, in the simplicity of the mechanism compared to those known previously, and in the small excursion of moving parts resulting in ease of adjustment and reliability of operation over long periods of time. Supporting flexible guide strips extend from the chute exit, generally in the direction of sheet movement, and interact with the gripper fingers to prevent sheet misfeed, thereby assuring entry of the leading edge of the sheet into the grippers even when such sheets are of various surface texture, stiffness, and edge integrity. The flexibility and arrangement of these support strips, in combination with the pivot constraint of the chute, permit minimum excursion of the chute from the inoperative position, where physical interference with the open gripper fingers is avoided, to the operative position in which the leading edge of the sheet is guided into the grippers. Details of this invention are set forth in the following.

Figure 4:
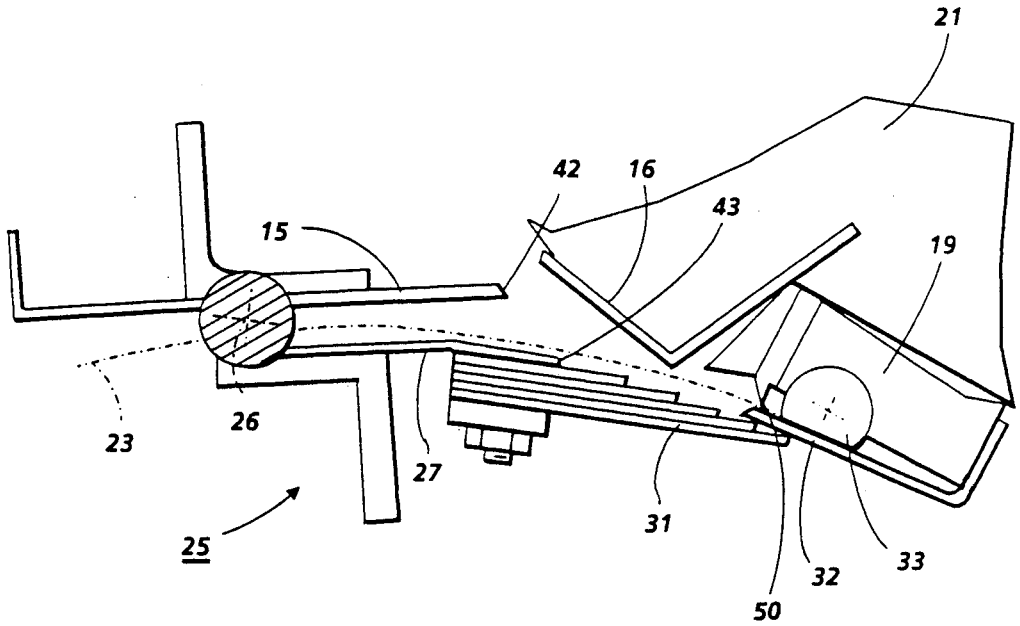
FIG. 4 shows the same construction of the Pivoted Chute 25 and Gripper Bar 19 during a phase of movement following that illustrated in FIG. 3. In this phase, the Gripper Fingers 32 have closed to hold the leading edge of the sheet and are in the process of moving the sheet forward into other segments of the printing machine.
Figure 4B:
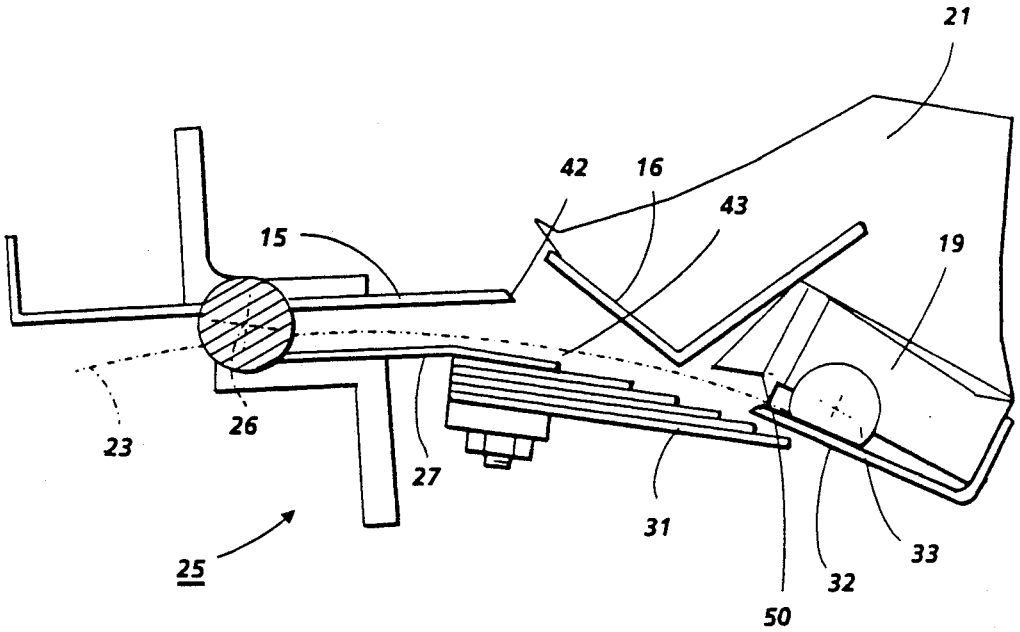

FIG. **4*b* is the same as FIG. 4** except that the gripper finger will not contact the strips when the finger is in its closed position.

Figure 5:
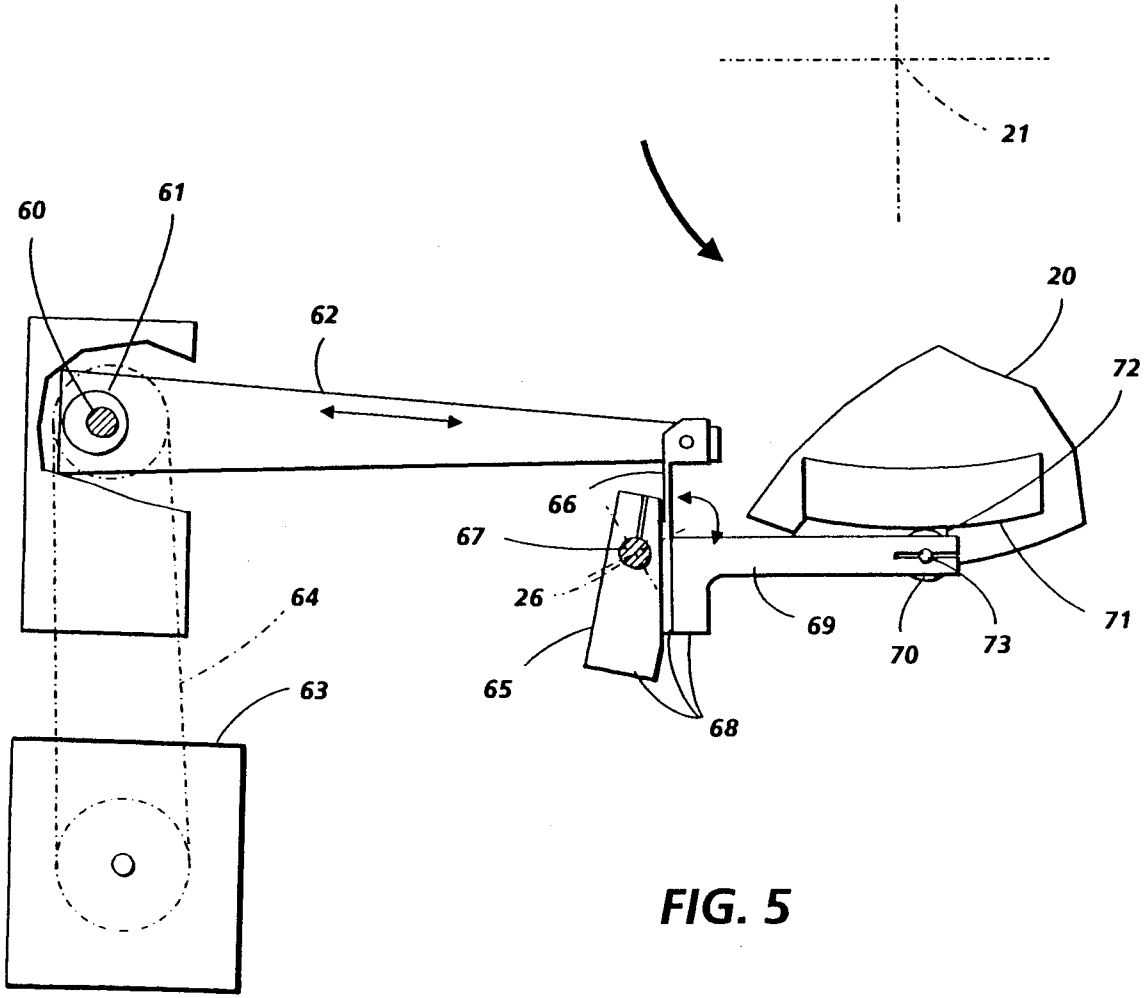

FIG. 5 shows a cross section of mechanism for actuating the Pivoted Chute 25 for movement between the operative and inoperative positions and for controlling the chute in the operative condition for precise positioning to avoid misfeed of the leading edge of the sheet.

DESCRIPTION OF THE PREFERRED EMBODIMENT

Figure 1:
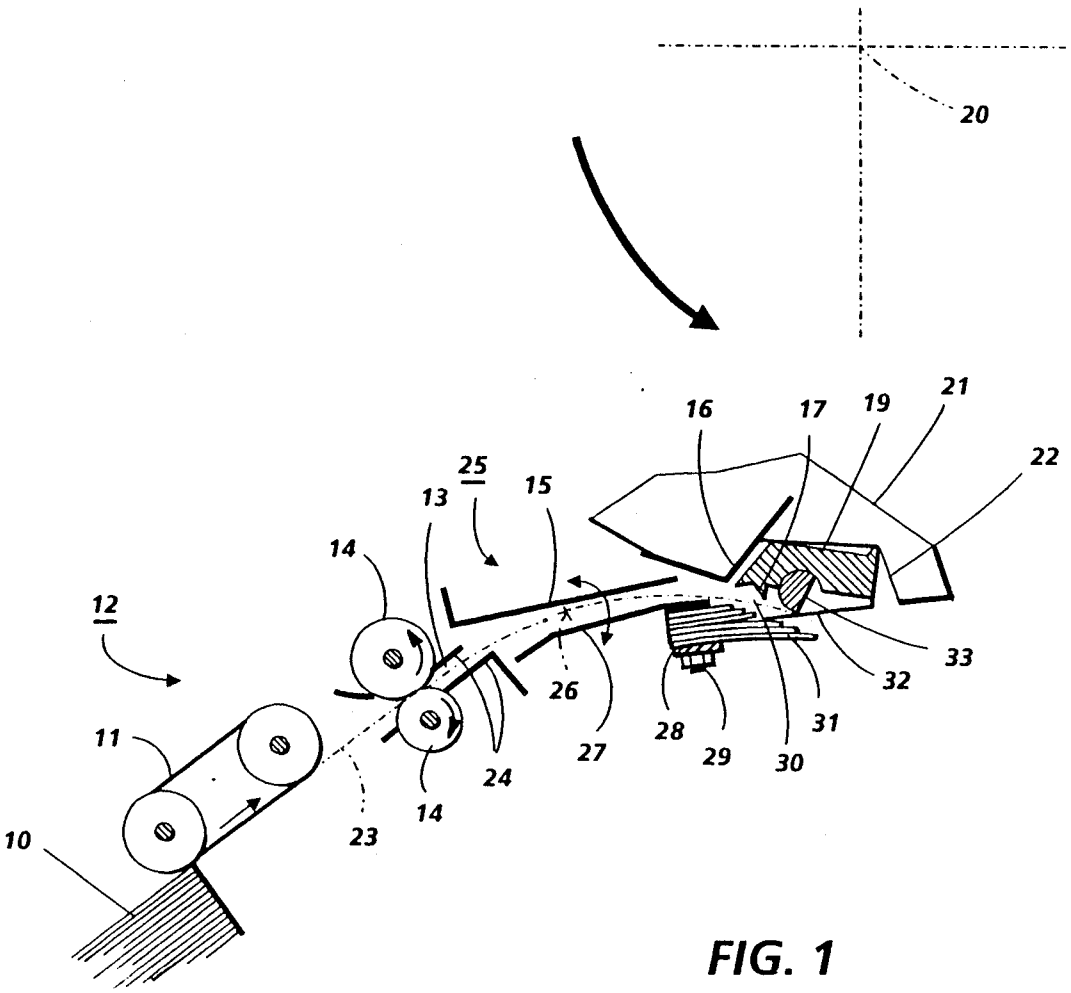
FIG. 1 shows a cross section of the infeed sheet path extending from the sheet Feeder Pile 10 to an array of grippers in a Gripper Bar 19 into which the leading edge of the sheet is conveyed. The mechanism controlling the Sheet Path 23 consists of a Friction Retard Separator 12 and a Pivoted Chute 25 for guiding the leading edge of the sheet into the throat of the open Gripper Bar 19. The Friction Retard Separator 12 consists of a Separator Belt 11 for separating the top sheet from the pile and of a pair of Feeder Rolls 14 for forwarding the sheet toward the Pivoted Chute 25.

With reference to FIG. 1, it will be seen that a group of sheets is arranged in a Feeder Pile 10 shown at the left of the illustration. The mechanism identified as the Friction Retard Separator 12, which is well known in the art, consists of a Separator Belt 11, to the left in the illustration, and a pair of Feeder Rolls 14. Through mechanisms well understood in the art and not shown in these illustrations, the Belt 11 is controllable to either move or be at rest. It is also controllable to be either in contact with the top of the Feeder Pile 10 or to be in a raised position, not illustrated, out of contact with the top of the Feeder Pile 10. The Feeder Rolls 14 are controllable to rotate as shown by the arrows in the illistration so as to convey the sheet through the fixed chute 24 in the general direction of the Gripper Bar 19, or be at rest. They are also controllable to form either a closed nip to exert pressure on a sheet within this nip or to be open so as to permit unconstrained passage of a sheet.

At the appropriate time of the machine cycle, and specifically in response to a signal provided by a machine controller such as is well understood in the art, the Friction Retard Separator 12 acts to separate the uppermost sheet in the pile by moving it forward, in the general direction of the printing machine, and to the right in this illustration. This action results from contact of the Friction Retard Separator Belt 11 with the top of the Feeder Pile 10 and movement of the Belt 11 in the direction of sheet movement. During this time, the Feeder Rolls 14 are in the aforementioned closed nip position and rotate in a direction likewise appropriate to the movement of the sheet. This phase of the sheet movement is normally termed staging.

It will be seen that the staging movement of the sheet is caused by frictional forces between the Belt 11 and the upper surface of the sheet and by the rolls acting on the top and bottom sufaces of the sheet. This movement stops when the leading edge of the sheet intercepts a sensor which causes the Belt 11 and Feeder Rolls 14 of the separator to stop their respective movements. The sensor, not shown in this illustration, is also well known in the art and may be a photoelectric or mechanical sensor. At the end of this staging movement, the leading edge of the sheet has reached a position slightly forward of the nip formed between the Feeder Rolls 14.

During this portion of the movement of the sheet, and for some time thereafter, the Pivoted Chute 25, shown in this illustration and to be described in further detail presently, is in the inoperative position to be described.

Later in the machine cycle, again in response to a signal provided by the machine controller, the Feeder Rolls 14 move again, in the same direction as before, and act to move the sheet into and through the Pivoted Chute 25. This further sheet movement is referred to as the forwarding movement.

The Pivoted Chute 25 and the elements associated with it to assure entry of the leading edge of the sheet into a Gripper Bar 19 are the principal subjects of this invention.

In this description reference will be made to a Gripper Finger 32. It will be understood that the embodiment of this invention may include a plurality of such Gripper Fingers 32, arranged across the width of the printing machine.

The Gripper Bar 19 is confined within a Guide Plate Notch 22 in a Guide Plate 21 which is an integral part of a rotating Infeed Roll 20, identified by its center line in this illustration. The means for holding the Gripper Bar 19 in this manner are generally known in the art and consist of a pair of chains and sprockets arranged laterally on each side of the machine and by Gripper Bar 19 carriers attached to the chains. Firm constraint of the Gripper Bar 19 in the Guide Plate Notch 22 is further provided by radially inward pressure exerted by a gripper opening mechanism not shown in this illustration but well understood in the art. For the purpose of this description, the Gripper Bar 19 may be thought of as affixed to the Infeed Roll 20 and travelling with it during the period pertinent to the infeed motion.

It will be seen that the Upper 15 and Lower 27 Guide Elements of the chute are formed to permit entry of the leading edge of the sheet irrespective of whether the chute is in the operative or inoperative position, at the upper and lower extremes, respectively, of the pivoting action. These two positions of the Pivoted Chute 25 will be described in greater detail in relation to FIGS. 2 and 3.

As the sheet progresses further in its motion, under the control of the Feeder Rolls 14, its leading edge moves past the exit of the chute and in the general direction of the Gripper Bar 19. The movement of the Gripper Bar 19 and of the opening of the Gripper Finger 32 is timed so that the leading edge of the sheet can enter into the Gripper Bar 19 in the area Gripper Finger 32 and the Gripper Pad 17, generally referred to as the Gripper Bar Throat 30. The velocity of the leading edge of the sheet is slightly faster than the corresponding circumferential velocity of the Gripper Bar 19, as determined by the rotation of the Infeed Roll 20. As a result the leading edge of the sheet tends to overtake and enter into the Gripper Bar Throat 29.

The alignment of the chute exit with the Gripper Bar Throat 30 is normally not adequate to completely assure entry of the leading edge of the sheet into the Gripper Bar Throat 30. In the absence of other elements, to be described presently, common defects such as folds, curl, bends, or other non-uniformities in this edge may cause the leading edge of the sheet to move above or below the Gripper Bar Throat 30 or, alternately, such defects may cause portions of the leading edge of the sheet to contact and be intercepted by the tips of Gripper Fingers 32 or other elements of the Gripper Bar 19. Any of these occurrances would prevent unimpeded entry into the Gripper Bar Throat 30. Elements are therefore provided in this invention to assist in control of the leading edge of the sheet to avoid these occurrances.

It will be seen that the Upper Guide Element 15 of the chute is in close proximity to a Sheet Guide 16 which is attached to, and therefore effectively is part of, the rotating Infeed Roll 20. The Gripper Bar 19 is formed and positioned so that the combination of the Upper Guide Element 15, the Sheet Guide 16, and the Gripper Bar 19 itself prevent stray movement of the leading edge of the sheet upwards and away from the intended sheet path. On the side below the Sheet Path 23, it is seen that the leading edge of the sheet is constrained by the Lower Guide Element 27 of the chute, by an arrangement of Flexible Guide Strips 31 to be described presently, and by the open Gripper Fingers 32.

The Flexible Guide Strips 31 are arranged adjacent to each other and affixed to the Lower Guide Element 27 of the chute by a Keeper Plate 28 and Screw Fasteners 29. The strips extend laterally across the machine. They are of varying width, with the uppermost strip being narrowest and the lowermost strip being widest. The strips are made to permit downward deflection by the tips of the Gripper Finger 32 but the material of the strips has sufficient stiffness so that under the force resulting from such downward deflection, close and continuous contact between the top surface of the respective Strip 31 and the Gripper Finger 32 is maintained. However, the stiffness of the strips and the resulting force exerted on the Gripper Finger 32 is not so great as to impede the normal movement of the Gripper Bar 19. While the number, thickness, and material of these strips can be selected from a wide range of parameters, it has been found advantageous to use a material commercially known as Mylar, to use strips of thickness approximately 0.010 inch (0.25 mm), and to use approximately 10 such strips, varying in width from about 1½ inches (38 mm) to about 2½ inches (64 mm).

As the open Gripper Finger 32 moves past the Lower Guide Element 27 of the Pivoted Chute 25, one or more of the strips in the array of Flexible Guide Strips 31 are deflected downwards. As the Gripper Finger 32 moves further, successive guide strips lose contact with, and are thus released from, the Gripper Finger 32 and are allowed to return to their upper, undeflected condition. During this process, the leading edge of the sheet moves through the chute exit and towards the Gripper Bar Throat 30. It will be seen that the action of the Flexible Guide Strips 31 described serves to provide a constraint on the lower side of the Sheet Path 23. As a result, the leading edge of the sheet is guided reliably into the Gripper Bar Throat 30, even in the presence of such non-uniformities in the edge as described heretofore.

During continued sheet movement as controlled by the Feeder Rolls 14 and slightly slower Gripper Bar 19 movement as controlled by the Infeed Roll 20, the leading edge of the sheet encounters a stop in the Gripper Bar 19, formed by a Gripper Bar Shaft 33, in a manner well understood in the art. Because of the speed differential in sheet movement and Gripper Bar 19 movement described, such action results in a buckle of the sheet extending laterally across the machine. In the presence of such a buckle the leading edge of the sheet is pressed against the Gripper Bar Shaft 33 firmly and uniformly across the width of the sheet, after which the Gripper Finger 32 closes on the sheet in response to a signal provided by the machine controller.

After the closing of the Gripper Finger 32, the sheet is under control of the Gripper Bar 19. Its further forward motion is at a speed slightly below the speed of the previous forwarding movement. After the Gripper Finger 32 has closed and the Gripper Bar 19 is thereby in control of further movement of the sheet, the Feeder Rolls 14 move out of contact with the sheet in response to a signal provided by the machine controller, and their rotary motion stops. Further movement of the sheet into the printing machine takes place in a manner well known in the art and is not the subject of this invention.

After the trailing edge of the sheet has passed through the Pivoted Chute 25 exit, the chute moves into the inoperative position. This movement is in a clockwise direction in the illustration of FIG. 1 and is more specifically illustrated in FIG. 2. In that position the Upper 15 and Lower 27 Guide Elements of the chute are moved away from the Infeed Roll 20, by pivoted movement of the chute to be described in greater detail presently. When the chute is in that position, all of its parts, and in particular the Upper 15 and Lower 27 Guide Elements are sufficiently remote from the Infeed Roll 20 so that the Gripper Bar 19, in subsequent movements, or passes, through this segment of the mechanism, can move past the chute without physical contact with any part of the chute. That condition applies both in the closed position of the Gripper Finger 32, which corresponds to successive passes of the Gripper Bar 19 while a sheet is held by the Gripper Finger 32, as well as in the open position of the Gripper Finger 32, which corresponds to the movement of the Gripper Bar 19 preparatory to receiving a successive sheet for subsequent printing.

The sequence of movements described is repeated during the infeed phase of each sheet to be fed into the Gripper Bar 19 for subsequent printing.

The Pivoted Chute 25, interacting with the Gripper Bar 19, representing the substance of this invention will next be described in greater detail with reference to FIGS. 2, 3, and 4.

Figure 2:
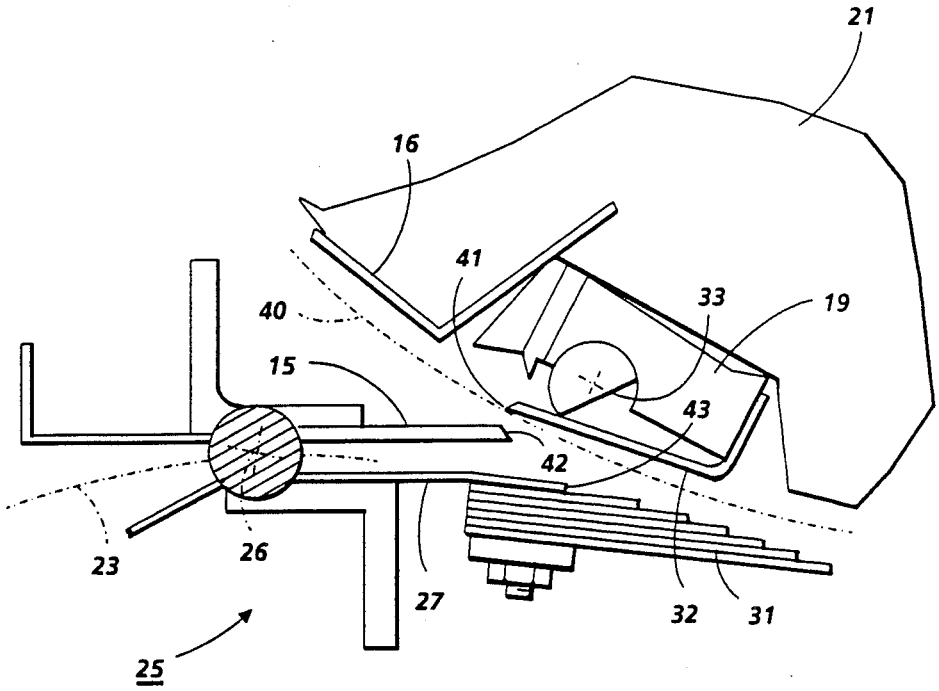
FIG. 2 shows details of the construction of this invention, in cross section, consisting of the Pivoted Chute 25, of the arrangement of Flexible Guide Strips 31 extending forward from the lower edge of the chute and generally in the direction of sheet movement, and of the Gripper Bar 19 which, with the Gripper Fingers 32 in their open condition, receives the leading edge of the sheet for subsequent transport into the printing machine.

FIG. 2, illustrating the Pivoted Chute 25 in the inoperative, clockwise position, shows that there is no physical interference between the elements rotating with the Infeed Roll 20 and those associated with the Pivoted Chute 25. More specifically, the extremity of the elements rotating with the Infeed Roll 20 is represented by the Gripper Finger Tip 41 moving along a path designated as the Tip Path 40. The extremities of the Pivoted Chute 25 path are respresented by the Upper Guide Element Tip 42, the Lower Guide Element Tip 43, and the Flexible Guide Strips 31. It will be seen that rotary movement of the Infeed Roll 20 and of the associated Gripper Bar 19 takes place without physical interference, provided the Pivoted Chute 25 is in the inoperative position shown. It will also be seen that in this inoperative position of the Pivoted Chute 25, the Flexible Guide Strips 31 are in the straight and undeflected condition. It will be seen, furthermore, that when the Gripper Finger Tip 41 is in the closed position, not shown in this illustration but in FIG. 4 to be discussed subsequently, the extremity of the elements rotating with the infeed Roll 20 are within the Tip Path 40. Interference with elements of the Pivoted Chute 25 is thus likewise avoided in this condition.

The Pivoted Chute 25 is in the inoperative position shown at all times except when a sheet is in the infeed phase of movement into the open Gripper Bar 19, as described heretofore. In particular, the Pivoted Chute 25 is in this position during those phases of the machine cycle when the Gripper Bar 19 conveys a sheet in the sheet path of the machine for printing successive color images on the sheet. During such conveying cycles, the Gripper Bar Fingers 32 are in the closed position in order to maintain firm control of the leading edge of the sheet. The Pivoted Chute 25 is also in this inoperative position when the Gripper Bar 19 moves into the sheet receiving position with the Gripper Finger 32 open, having previously released a sheet for movement elsewhere in the machine. During such movement into the sheet receiving position, the Pivoted Chute 25 remains in the inoperative position until the Gripper Finger Tip 41 has moved in a counterclockwise direction past the Upper Guide Element Tip 42. During this phase of the machine cycle, as shown in this illustration, the leading edge of the sheet has advanced along a trajectory indicated as Sheet Path 23 into the Pivoted Chute 25 but has not yet reached the chute exit. After the Gripper Finger Tip 41 has moved past the Upper Guide Element Tip 42 and is in close proximity to the Lower Guide Element Tip 43, the Pivoted Chute 25 moves into the operative position to be described presently, in response to a signal from the machine controller.

Figure 3:
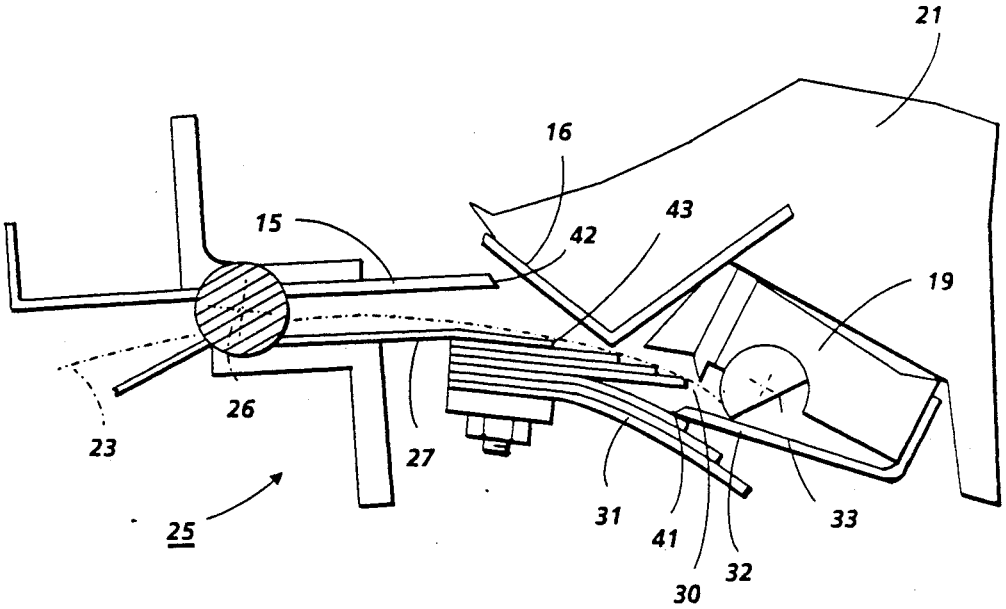
FIG. 3 shows the same construction of the Pivoted Chute 25 and the Gripper Bar 19. However, in this figure, these elements are shown in their operative position, in which they interact to convey the sheet leading edge into the Gripper Bar 19.

FIG. 3 shows the Pivoted Chute 25 in the operative, counterclockwise position, with the Gripper Bar 19 in a position to receive the sheet and with the Gripper Finger 32 ready to close on the leading edge of the sheet. During the period of time extending from the condition illustrated in FIG. 2 to that illustrated in FIG. 3, the leading edge of the sheet has moved through the exit of the Pivoted Chute 25 while the Gripper Bar 19 has moved further in rotation with the Infeed Roll 20 so that the Gripper Finger Tip 41 has passed the Lower Guide Element 27 of the Pivoted Chute 25 and has caused successive Flexible Guide Strips 31 to deflect, starting with the narrowest strip and progressing toward the wider strips. As the Gripper Finger Tip 41 passes successive forward Flexible Guide Strip 31 edges, these strips are no longer restrained in a deflected condition by the Gripper Finger Tip 41 and return to their normal undeflected condition.

In the condition illustrated in FIG. 3, the upper, narrower strips in the Flexible Guide Strip 31 array are seen to be out of contact with the Gripper Finger 32 and therefore in their straight undeflected condition. However, the lower, wider strips in this array are seen to be deflected downwards by the Gripper Finger Tip 41. The leading edge of the sheet as shown in this illustration has entered the Gripper Bar Throat 30 and has reached the Gripper Bar Shaft 33 which serves as a stop preventing further movement of the leading edge of the sheet into the Gripper Bar 19.

It may be seen from FIG. 3 that the space in which the leading edge of the sheet moves forward out of the exit of the Pivoted Chute 25 and in the general direction of the Gripper Bar Throat 30 as heretofore described, is confined above and below so that misfeed above or below the Gripper Bar 19 is successfully avoided.

A particular advantage of the Pivoted Chute 25 and the Flexible Guide Strips 31 relates to the reliable control of sheets which may arrive in the general area of the Gripper Bar 19 later than is normally provided by the adjustment of timing events and by the speed control of the machine. In mechanisms such as illustrated, it is common that the frictional characteristics of the upper and lower surfaces of sheets vary from an expected normal condition and that this results in slippage of a sheet in the Feeder Rolls 14. In that event, the sheet may be retarded from its normal motion and its leading edge therefore reaches the Gripper Bar Throat 30 later than corresponds normally to the intended timing of the machine. In such instances, it should be understood that the Gripper Bar 19 may have moved further than indicated by the position illustrated in FIG. 3 before the leading edge of the sheet reaches the Gripper Bar Shaft 33. Since the speed of motion of the sheet, as controlled by the Feeder Rolls 14, is greater than that of the Gripper Bar 19, the leading edge of the sheet may then be expected to reach the Gripper Bar Shaft 33 at a time when the Gripper Bar 19 is located somewhat to the right of the position illustrated in FIG. 3. In that event, additional Flexible Guide Strips 31 will have been released by the Gripper Finger Tip 41, but, as is also evident in this illustration, one or more of the wider Flexible Guide Strips 31 will still be in the deflected condition and thereby prevent any gap from occurring near the Gripper Finger Tip 41 which might otherwise permit misfeed of the leading edge of the sheet. It is therefore seen that the arrangement of Flexible Guide Strips 31 serves to assure reliable entry of the leading edge into the Gripper Bar Throat 30 even for a sheet which reaches the Gripper Bar Throat 30 somewhat later than normally expected.

FIG. 4 shows the same elements as the previous two illustrations but with the Gripper Finger 32 closed on the leading edge of the sheet. The closing of this finger is controlled by means well understood in the art and occurs in response to a signal from the machine controller. It may be seen that this closing action of the Gripper Finger 32 has occurred as a result of clockwise movement of the Gripper Bar Shaft 33, actuated by mechanism at one or both ends of the Gripper Bar 19 and not shown in this illustration. This clockwise movement of the Gripper Bar Shaft 33 permits the Gripper Finger 32 under the influence of its elasticity to move in a manner such as to clamp the leading edge of the sheet against an Anvil 50 above the sheet. The action of the elastic Gripper Finger 32 and the Anvil 50, as is well known in the art, serves to clamp the leading edge of the sheet firmly during the subsequent printing process in other segments of the machine, until such time as the leading edge of the sheet is released from the Gripper Finger 32 through suitable gripper opening mechanism, not shown in this illustration but well understood in the art.

As shown, the right edges of the strips 31 make slight contact with the gripper finger even when the finger is in its closed position. To reduce wear on the flexible guide strips 31, one or several of a plurality of dimensions of this mechanism may be varied so that the finger 32 will not contact the strips 31 when the finger 32 is in the closed position. Examples of possible variations to accomplish this result would be a decrease in the width of the guide strips 31, a shortening of the pad 17 to allow the finger 32 to close at a higher position and an angle of the chute 25 slightly clockwise of that shown.

The timing of the Gripper Bar 19 closing action is such that even a sheet which arrives in the Gripper Bar Throat 30 later than expected, as described heretofore, is firmly pressed against the stop formed by the Gripper Bar Shaft 33 and has caused a slight buckle to be formed in the sheet to assure firm seating of the leading edge of the sheet in the Gripper Bar 19. It will be understood from the illustration that such a buckle may occur in an area generally near the exit of the Pivoted Chute 25. The dimensions of the chute and of the Sheet Guide 16 are such that this buckle can be formed without causing wrinkles or folds in the sheet.

FIG. 5 shows the mechanism for driving and controlling the Pivoted Chute 25 movement. It will be seen that the Chute Pivot Shaft Extension 67 shown in this illustration is centered on the Chute Pivot Center Line 26 also shown in the preceding figures. Mechanism will now be described which causes the clockwise and counterclockwise pivot movement of the Pivoted Chute 25 about this center line.

Chute Pivot Arms 68 are rigidly affixed to the Chute Pivot Shaft Extension 67, preferably on both sides of the machine so as to preserve symmetry and synchronism of the mechanism and to minimize adverse effects of structural deflections from one side of the machine to the other. Chute Pivot Arms 68 consist of Clamp Fitting 65, Flexible Cantilever Arm 66 and Stabilizing Arm 69, all to be described. Connecting Rods 62 are attached to the upper ends of the arms, and these rods, in turn, cause the arms to move as a result of intermittent rotary motion of Chute Drive Eccentrics 61. It may be seen that when the Chute Drive Eccentrics 61 are directed to the left hand side in the illustration, such as shown, the Connecting Rods 62 are likewise in their extreme left hand positions and the Chute Pivot Arms 68 as well as the Chute Pivot Shaft Extension 67 and the chute are in their respective extreme counterclockwise positions. As described previously, this position of the Pivoted Chute 25 corresponds to its operative position. Conversely, when the Chute Drive Eccentrics 61 are directed to the right hand side, not illustrated but understood to be one half revolution away from the position shown in the illustration, the Connecting Rods 62 are in their extreme right hand positions and the Chute Pivot Arms 68 as well as the Chute Pivot Shaft Extension 67 and the chute are in their respective extreme clockwise positions. This position of the Pivoted Chute 25 corresponds to its inoperative position.

The two Chute Drive Eccentrics 61, one on each side of the machine, are affixed to the ends of a Chute Drive Shaft 60 whose intermittent unidirectional motion is controlled by way of an intermediate timing belt transmission and a Stepping Motor 63. Such motors are well known in the art and are particularly well adapted to being actuated intermittently in response to signals from the machine controller and to providing the intermittent movement required. In this manner the Chute Drive Shaft 60 is caused to move one half revolution at a time, always moving in the same direction, with each such half revolution causing the Pivoted Chute 25 to move from one extreme of its rotary excursion to the other. It will be understood that the means for causing such intermittent reciprocating pivoting movement of the Pivoted Chute 25 is only one of many such means known in the art.

Special means are provided as part of this invention for assuring the precise positioning of the Pivoted Chute 25. Such precision is effective so that the actuation on each side of the machine is properly synchronized and to avoid the effects of misalignments which might result from the flexibility of long elements extending across the machine such as the Pivoted Chute 25.

It will be seen in FIG. 5 that the Chute Pivot Arm 68 consists of a Clamp Fitting 65 firmly attached to the Chute Pivot 67, a Flexible Cantilever Arm 66 extending in an essentially vertical direction from the Clamp Fitting 65, and a Stabilizing Arm 69 extending essentially to the right of the Clamp Fitting 65. All three of these elements are fastened together at the right of the Clamp Fitting 65 by fastener means well understood in the art but not shown in this illustration. The three elements therefore move together in rotation as described. The right end of the Connecting Rod 62 is attached to the top end of the Flexible Cantilever Arm 66. A Cam Roller 70 affixed to the right hand end of the Stabilizing Arm 69 is seen to rest on a Stabilizing Pad 71 attached to a Guide Plate 21 which, in turn, is structurally a part of the Infeed Roll 20. It should be understood that the assembly is shown in the operative, extreme counterclockwise position of the Pivoted Chute 25. It should also be understood that the vertical portion of the Flexible Cantilever Arm 66 is designed to be flexible, by means well understood in the art, to provide the action to be described presently.

The arrangement of the elements described in the foregoing and constituting the Chute Pivot Arm 68 is such that, as the rotation of the Chute Drive Eccentrics 61 causes the Connecting Rods 62 to move to the left, from the inoperative to the operative position as heretofore described, the Cam Rollers 70 make contact with their respective Stabilizing Pads 71 slightly before the Connecting Rods 62 reach their left hand extreme positions. At that time the Pivoted Chute 25 is in the precise position found to be best for assuring entry of the leading edge of the sheet into the Gripper Bar Throat 30 as previously described. Mechanism well known in the art is provided to permit adjustment on each side of the machine to cause this condition to be achieved. Such mechanism may consist of Eccentric Pins 73 supporting the Cam Rollers 70, permitting these rollers to rotate freely about an axis whose position relative to the Stablilizing Arm 69 can be adjusted by rotational movement of such pins and by clamping of such pins in the adjusted position.

As the Chute Drive Eccentrics 61 continue in their rotation with the Chute Drive Shaft 60, the Connecting Rods 62 complete their movement to their extreme left hand position. Such further movement causes deflection of the Flexible Cantilever Arm 66 but, because of the contact restraint between the Cam Rollers 70 and the Stabilizing Pad 71, further movement of the Chute Pivot Arm 68 or of the Pivoted Chute 25 is prevented. It will be seen that the surface of the Stablizing Pads 71 extends over a sufficiently wide angle to maintain this restraint of the Cam Rollers 70 against further radially inward movement over an extended rotation of the Infeed Roll 20 and over a period during which accurate positioning of the Pivoted Chute 25 is required for appropriate functioning of the mechanism.

During further rotation of the Chute Drive Eccentrics 61, from the operative toward the inoperative position, the Connecting Rods 62 initially move to the right side only to reduce the deflection of the Flexible Cantilever Arms 66 but without causing movement of the Chute Pivot Arm 68. After the arms have reached the straight, undeflected condition, further movement of the Connecting Rods 62 serves to cause counterclockwise rotation of the Pivoted Chute 25 and movement to the inoperative position.

This arrangement causes the precise operative position of the Pivoted Chute 25 to be determined principally by the positions of the Stablizing Pads 71 and of the Cam Rollers 70, elements whose dimensional control, position, and adjustment is effectively accomplished by means well understood in the art. The less readily controlled dimensional accuracy and mechanical deflection of other elements in the mechanism have no effect on the precision of the operative position of the Pivoted Chute 25.

The mechanism described represents a preferred embodiment of the invention. It should be understood that other embodiments incorporating the same principles can be constructed to achieve the same beneficial results. In particular, instead of the Gripper Bar 19 constrained to move on the Infeed Roll 20, as described in the foregoing, it is well known in the art that sheets to be printed can be conveyed effectively by means of an array of grippers permanently affixed to a transfer drum. The invention described is equally suited to feed sheets from a Feeder Pile 10 into such an array of grippers and using elements and movement controls essentially similar to those described. Likewise, other drive means than those described may be employed to cause the Pivoted Chute 25 to be placed into a timed and precise position for reliable movement of the leading edge of a sheet to be printed into an array of grippers.

I claim:

1. An Infeed mechanism for advancing and guiding the leading edge of a sheet into a sheet constraining means comprising an upper anvil and a lower gripper finger movable between an open and a closed position, said sheet constraining means providing a space between said anvil and said finger in said gripper finger open position for receiving said leading edge, and forming a clamp on said sheet between said anvil and said finger in said closed position, said mechanism comprising:

a chute comprising an upper surface and a lower surface for guiding said sheet toward said space, and a plurality of flexible strips of graduated width attached to and extending from the lower surface, the narrower of said strips being located above the wider strips, said strips constituting extensions of said lower surface, said chute further comprising means for positioning said chute in a first position wherein said gripper finger in said open position sequentially contacts and displaces said strips in cantilever fashion during movement of said constraining means to form a continuity between said lower surface and said finger.

2. The mechanism of claim 1 wherein said chute is positioned in its first position so that said gripper finger will not contact said strips when said finger is in its closed position.

3. The means of claim 1 wherein said means for positioning also repositions said chute into a second position wherein said strips do not contact said finger when said finger is in its open position.

4. The infeed means of claim 3 wherein said sheet constraining means is attached to a rotating drum at the time when the leading edge of said sheet enters the space between said anvil and finger and said means for positioning further comprises a cam surface on said drum, a roller attached to said chute and bias means for forcing said roller toward said cam surface to accurately position said chute in its first position.

5. An infeed mechanism for feeding a sheet forward into the space between an upper member and a lower member of a moving gripper, said lower member adapted to be moved between open and closed positions, comprising:

a chute having lower and upper surfaces between which said sheet is fed forward toward said gripper, a stack of horizontal flexible strips which are attached to the forward end of said lower surface of said chute and are positioned as an extension of said lower surface, the lowest of said strips being the longest of said strips to create a longer extension of said chute, and means for positioning said chute in a first position so that one or more of said strips sequentially contact said lower member of said gripper and are deflected in cantilever fashion as said gripper moves past said chute.

6. The mechanism of claim 5 wherein said chute is positioned in its first position so that the lower gripper member in its closed position will not contact said strips.

7. The mechanism of claim 5 wherein said means for positioning repositions said chute into a second position away from said gripper so that said strips will not contact said lower member in said open position.

8. The infeed mechanism of claim 7 wherein said gripper is attached to a drum at the time when the leading edge of said sheet enters the space between said upper and lower members, further comprising a cam surface on said drum, a roller attached to said chute and bias means for biasing said roller toward said cam surface to accurately position said chute in its first position.

* * * * *